US009999268B2

(12) United States Patent
Pagcaliwagan

(10) Patent No.: US 9,999,268 B2
(45) Date of Patent: Jun. 19, 2018

(54) SHIRT STAY

(71) Applicant: Robert Pagcaliwagan, Chula Vista, CA (US)

(72) Inventor: Robert Pagcaliwagan, Chula Vista, CA (US)

( * ) Notice: Subject to any disclaimer, the term of this patent is extended or adjusted under 35 U.S.C. 154(b) by 0 days. days.

(21) Appl. No.: 14/795,887

(22) Filed: Jul. 9, 2015

(65) Prior Publication Data

US 2016/0007666 A1 Jan. 14, 2016

Related U.S. Application Data

(60) Provisional application No. 62/022,204, filed on Jul. 9, 2014.

(51) Int. Cl.
*A41F 17/00* (2006.01)
*A41F 19/00* (2006.01)

(52) U.S. Cl.
CPC ..... *A41F 17/00* (2013.01)

(58) Field of Classification Search
CPC .. A41F 17/00; A41F 11/16; A41F 3/00; A41F 15/002; A41F 19/00; A41F 3/02; A41F 5/00; A41F 11/14; Y10S 2/92
See application file for complete search history.

(56) References Cited

U.S. PATENT DOCUMENTS 311,111 A * 1/1885 Eisler ..... A41F 3/00 2/326
755,188 A * 3/1904 Tooker ..... A41F 9/002 2/300
863,970 A * 8/1907 Ebersole ..... A41F 3/00 2/326
1,374,572 A * 4/1921 Hurd ..... A41F 11/16 2/308
1,404,181 A * 1/1922 Alsop ..... A41F 11/16 2/308
1,404,719 A * 1/1922 Postl ..... A41F 11/02 2/326
1,535,650 A * 4/1925 Burtchby ..... A41F 11/14 450/106
1,638,304 A * 8/1927 Guy ..... A41F 11/02 2/326
1,653,288 A * 12/1927 Johnson ..... A41F 17/00 2/326
1,859,097 A * 5/1932 Kayser ..... A41F 11/02 2/313

(Continued)

OTHER PUBLICATIONS hypoallergenic. Dictionary.com. Dictionary.com Unabridged. Random House, Inc. http://www.dictinoary.com/browse/hypallergenic (accessed: May 22, 2017).*

*Primary Examiner* — Bobby Muromoto, Jr.
(74) *Attorney, Agent, or Firm* — Kafantaris Law Offices; Theo Kafantaris

(57) ABSTRACT

A device is disclosed which is comfortable to wear for extended periods of time, can quickly and easily attach and detach from the shirt in any order, is effective at preventing a shirt from becoming untucked, does not pull on leg hair, provides knee support, and will not project the pants behind the knee outward when kneeling or sitting. As such, the device serves to keep formal attire tucked and taught, promoting an all-day impeccable professional appearance without undue burden or discomfort.

11 Claims, 6 Drawing Sheets

(56) References Cited

U.S. PATENT DOCUMENTS 2,145,514 A * 1/1939 Kennedy ..... A41F 11/16 2/308
3,501,774 A * 3/1970 Norman ..... A41F 11/16 2/240
4,853,979 A * 8/1989 Ryder ..... A41F 17/00 2/326
7,849,523 B2 * 12/2010 Crittenden ..... A41F 11/14 2/232
8,291,515 B2 * 10/2012 Carter ..... A41B 1/08 2/117
8,429,773 B2 * 4/2013 Herman ..... A47C 21/022 24/72.5
9,049,895 B1 * 6/2015 Wesol ..... A41F 5/00
2009/0235432 A1 * 9/2009 Crittenden ..... A41F 17/04 2/232
2010/0235969 A1 * 9/2010 Isaacson ..... A41F 17/00 2/404
2011/0099686 A1 * 5/2011 Carter ..... A41B 1/08 2/117
2011/0167540 A1 * 7/2011 Little ..... A41F 9/002 2/312
2013/0247280 A1 * 9/2013 Haggard ..... A41F 11/14 2/256
2015/0135395 A1 * 5/2015 Galil ..... A41F 17/00 2/69
2016/0198784 A1 * 7/2016 Gilroy ..... A41F 3/02 2/326
2016/0338436 A1 * 11/2016 Horrey ..... A41F 17/00

* cited by examiner

SHIRT STAY

CROSS-REFERENCE TO RELATED APPLICATIONS

This application claims the benefit of U.S. Provisional Patent Application No. 62/022,204, filed on Jul. 9, 2014, and incorporated herein by reference.

STATEMENT REGARDING FEDERALLY SPONSORED RESEARCH AND DEVELOPMENT

Not Applicable.

FIELD OF THE INVENTION

The present invention relates generally to a shirt stay, and more particularly, to a device having a plurality of straps and clips for maintaining formal attire.

DISCUSSION OF RELATED ART

A shirt stay can generally be described as a device which discretely prevents a shirt from untucking during the course of the day. Shirt stays are commonly used with military and law enforcement uniforms, where the appearance of a squarely tucked and fitted wrinkle free shirt is paramount. Furthermore, military appearance is a characteristic trait that is observed, graded and considered during promotion reviews in all services. Accordingly, use of shirt stays to enhance one's appearance has become increasingly popular.

Current shirt stays comprise one or a plurality of elastic straps that connect to the socks or feet on one end and the shirt on the other. Here, the tension between the feet or socks and the shirt will prevent the shirt from untucking and will prevent any wrinkles from displaying, as the shirt is held taught. Other methods of keeping a shirt tucked in include rubber belts, molded hooks, or suspenders.

While several methods for preventing a shirt from untucking exist in the prior art, they are generally uncomfortable, easily unfasten, difficult to attach and/or remove, require a specific order when attaching, unduly burdensome on the feet and legs, or are simply ineffective. Furthermore, the most common types of shirt stays typically pull on leg hair as they become taught and cause the pants behind the knee to project outward when kneeling or sitting. Therefore, a need exists for a device which is comfortable to wear for extended periods of time, can quickly and easily attach and detach from the shirt in any order, is effective at preventing a shirt from becoming untucked, does not pull on leg hair, provides knee support, and will not project the pants behind the knee outward when kneeling or sitting. The present invention satisfies these needs.

SUMMARY OF THE INVENTION

The present invention provides a device which is comfortable to wear for extended periods of time, can quickly and easily attach and detach from the shirt in any order, is effective at preventing a shirt from becoming untucked, does not pull on leg hair, provides knee support, and will not project the pants behind the knee outward when kneeling or sitting. As such, the present invention serves to keep formal attire tucked and taught, promoting an all-day impeccable professional appearance without undue burden or discomfort.

The above objectives are accomplished through a knee strap, one or a plurality of elastic bands, and one or a plurality of shirt attachment clamps. The knee strap will attach to the leg below the knee, the plurality of shirt attachment clamps will securely attach to the shirt, and the elastic bands will connect them together. When in use, the present invention will be attached or detached below the pants, and as such, will be concealed from view. Lastly, the present invention will be adjustable for all different body types.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
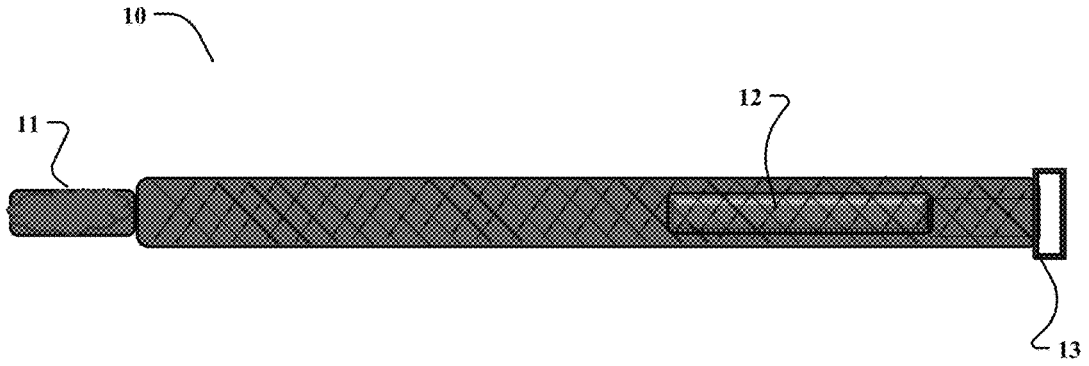
FIG. 1 is a top view of the knee strap of the present invention.
Figure 2:
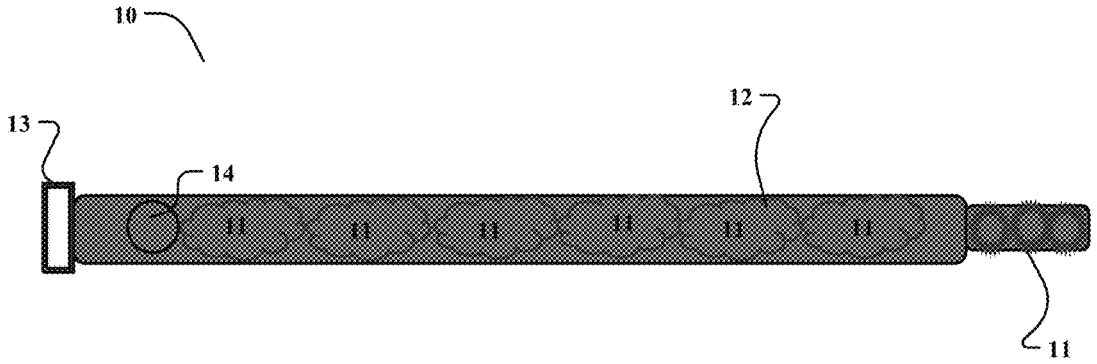
FIG. 2 is a bottom view of the knee strap of the present invention.
Figure 3:
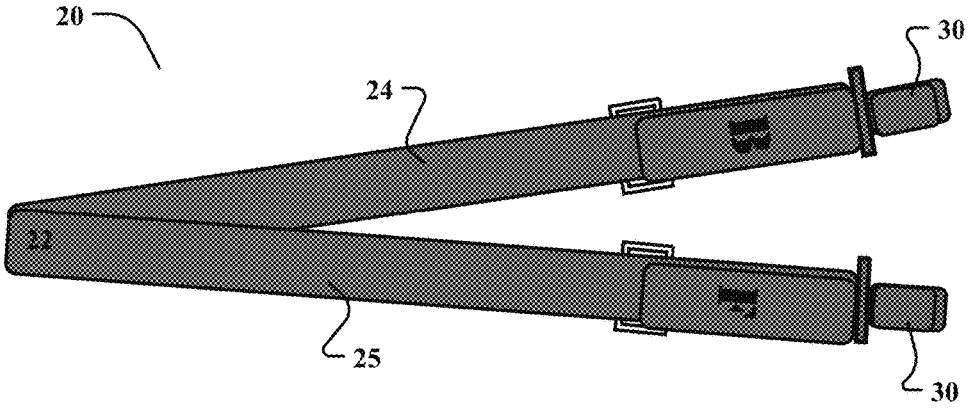
FIG. 3 is an extended top view of the elastic bands of the present invention.
Figure 4:
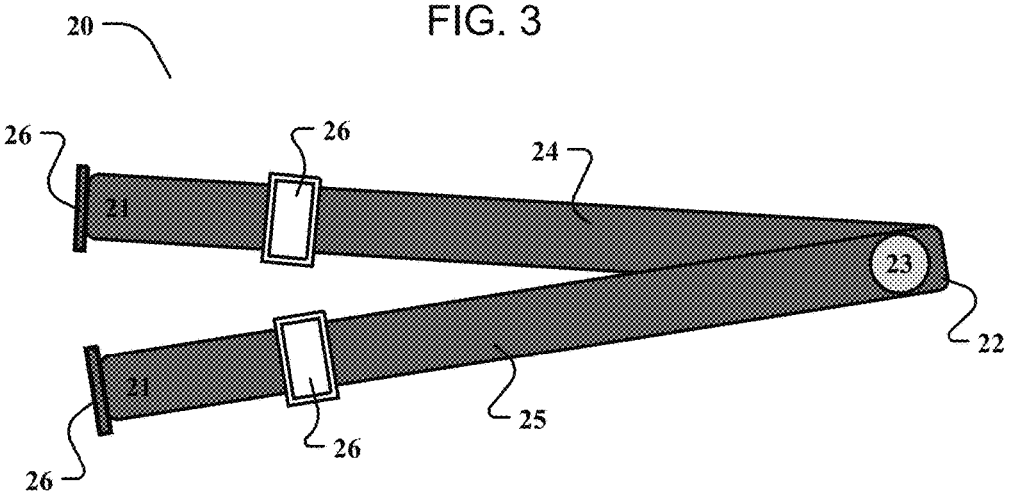
FIG. 4 is an extended bottom view of the elastic bands of the present invention.
Figure 5:
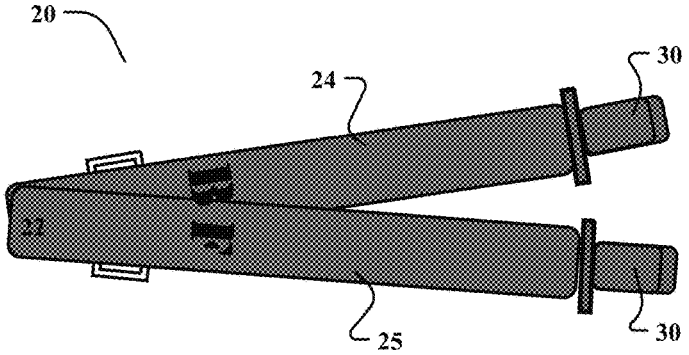
FIG. 5 is a contracted top view of the elastic bands of the present invention.
Figure 6:
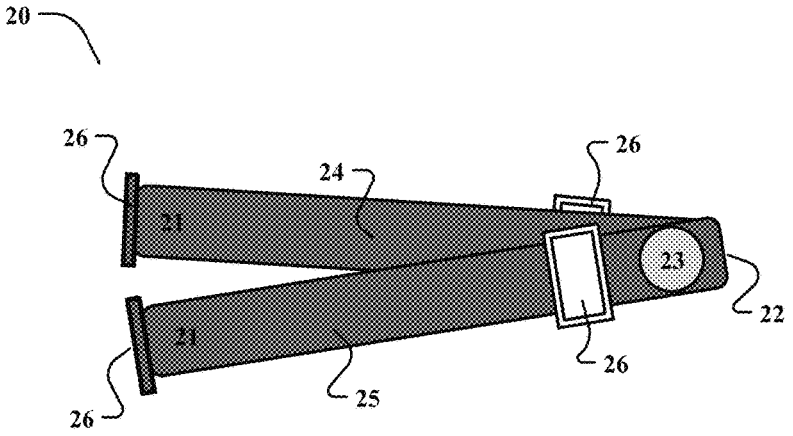
FIG. 6 is a contracted bottom view of the elastic bands of the present invention.
Figure 7:
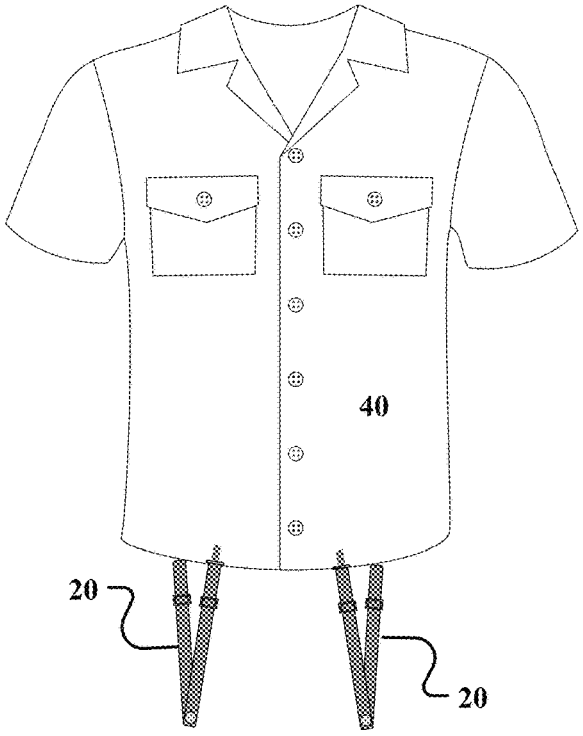
FIG. 7 is a front view of the present invention attached to a shirt.
Figure 8:
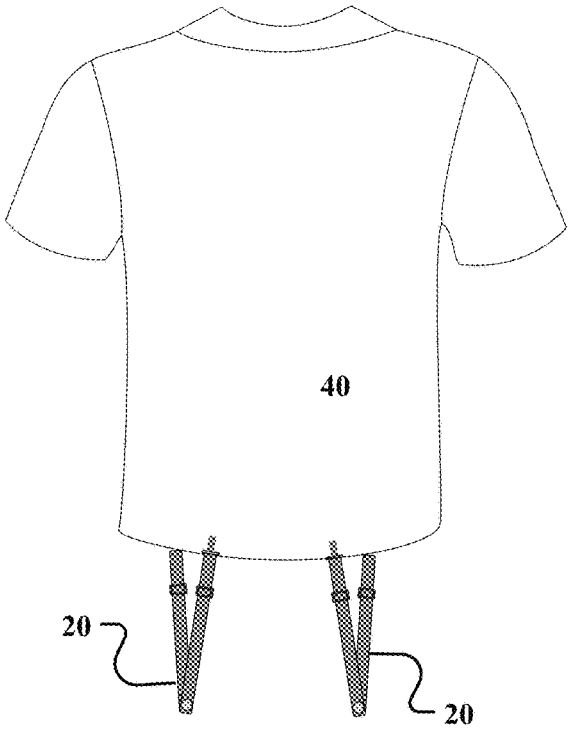
FIG. 8 is a rear view of the present invention attached to a shirt.
Figure 9:
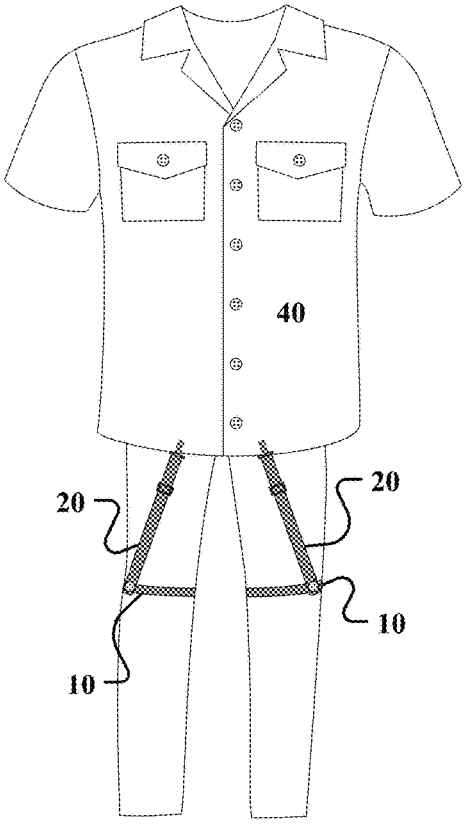
FIG. 9 is a front view of the present invention attached to a shirt and below the knees.
Figure 10:
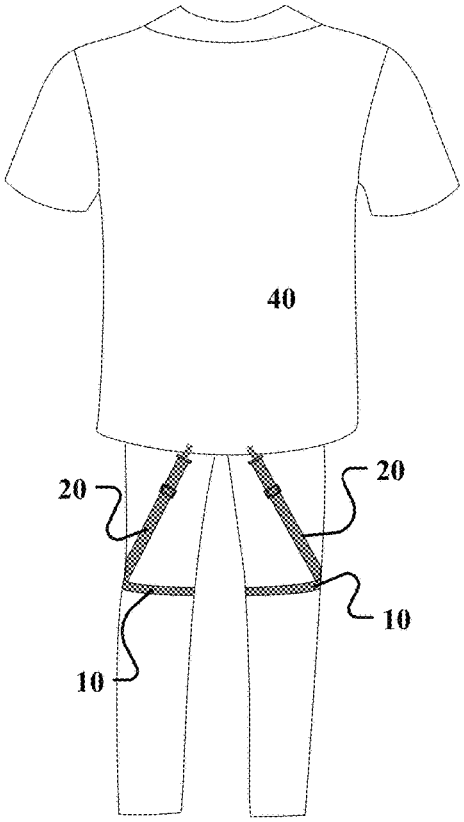
FIG. 10 is a rear view of the present invention attached to a shirt and below the knees.
Figure 11:
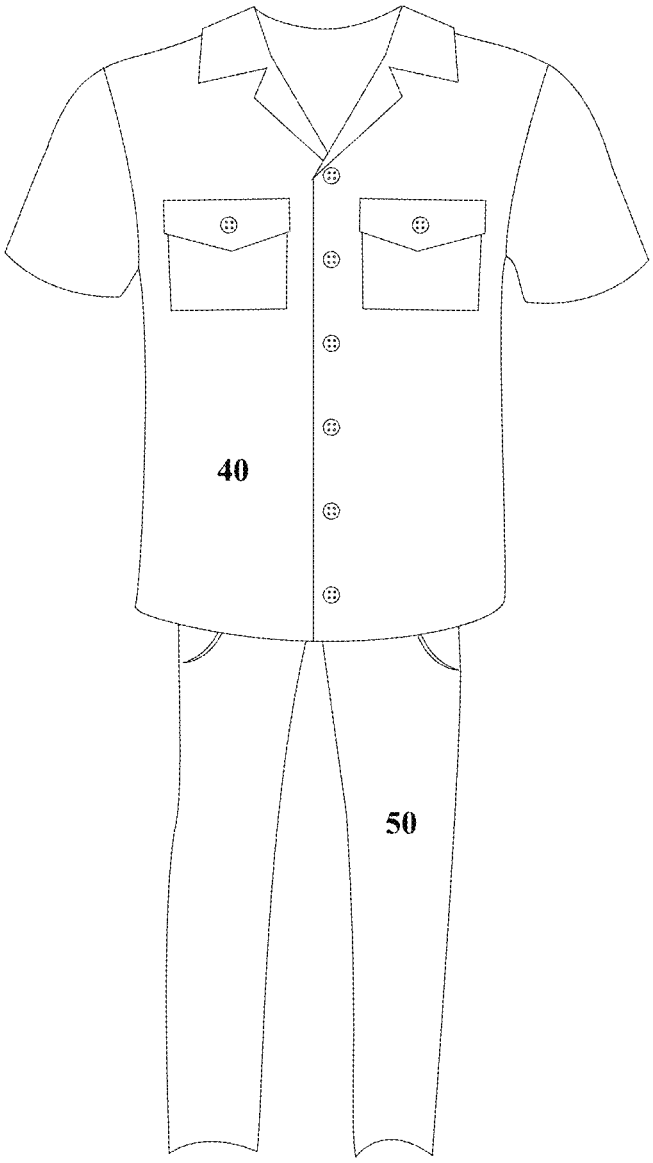
FIG. 11 is a front view of the present invention concealed below pants.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention comprises a knee strap 10, one or a plurality of elastic bands 20, and one or a plurality of shirt attachment clamps 30. In combination, the present invention will prevent a shirt 40 from becoming untucked or showing wrinkles. This is accomplished by securing the knee strap 10 to the knee of the user, securing the plurality of attachment clamps 30 to the shirt 40, and utilizing the elastic bands 20 to pull the two together. Each element will be discussed in further detail below, and the present invention may be attached to the user and their clothing in any order.

The knee strap 10 comprises a band that attaches below the knee, specifically, below the patella, such that it is tight and secure on the leg, yet comfortable to wear for extended periods of time. Specifically, the knee strap 10 will be attached 2 inches below the patella of the user such that it will not interfere with the knee when it bends. The knee strap 10 comprises a means of attachment 11 such that the knee strap may be temporarily attached to the user. In the preferred embodiment, the means of attachment 11 is a hook and loop type fastener. The knee strap 10 further comprises a padded section 12 opposite the attachment means 11 for providing padded support to the knee.

The knee strap 10 further comprises a strap length adjustment means 13 to adapt to each individual user. In the preferred embodiment, the strap length adjustment means 13 is an adjustable ring, slide, hook, buckle, clasp, clamp, or other length adjustable apparatus. The strap length adjustment means 13 may be incorporated with said means of attachment 11 such that said hook and loop type fastener will attach about said strap length adjustment means 13. The knee strap 10 is made of a hypoallergenic material that is comfortable, breathable, durable, easily laundered, and slightly elastic to further accommodate fit and comfort.

Lastly, the knee strap 10 further comprises a pivoting attachment means 14 for attaching the elastic bands 20. The pivoting attachment means 14 is positioned adjacent to the padded section 12, and are positioned on the outer sides of the knees, opposing each other such that each pivoting attachment 14 is on the left and right sides of the knees/legs. In the preferred embodiment, the pivoting attachment means 14 further comprises a male and female attachment means, specifically button snaps, with a male button snap attached to each knee strap 10. The pivoting attachment 14 provides a pivoting point for the present invention such that, when sitting, the present invention does not protrude the pants 50 in the area behind the knee.

The plurality of elastic bands 20 each comprise a proximal 21 and distal 22 end. Each distal end 22 comprises a female pivoting attachment means 23 adapted to pivot with the attachment means 14 of the knee strap 10. In the preferred embodiment, the female attachment means 23 is a female button snap adapted to pivotally attach to said male button snap. Just as the male attachment means 14, the female attachment means 23 provides a pivoting point for the present invention such that, when sitting, the present invention does not protrude the pants 50 in the area behind the knee.

Each of said plurality of elastic bands 20 further comprises a first elastic band 24 and a second elastic band 25. The first and second elastic bands 24, 25, inherently, each have a proximal 21 and distal 22 end. The first and second elastic bands 24, 25 are each attached to said female attachment means 23 at their distal ends, forming a generally V-shape. The first and second elastic bands 24, 25 are made of a hypoallergenic material that is comfortable, durable, generally elastic, and easily laundered.

Said first and second elastic bands 24, 25 further comprise a band length adjustment means 26 to adapt to each individual user. In the preferred embodiment, the band length adjustment means 26 is an adjustable ring, slide, hook, buckle, clasp, clamp, or other adjustable means. The band length adjustment means 26 may be incorporated with said female attachment means 23 such that band length adjustment means 26 will adjust the length of said first and second bands 24, 25 about said female attachment means 23. The first and second elastic bands 24, 25 are made of a hypoallergenic material that is comfortable, durable, easily laundered, and elastic to further accommodate fit, comfort, and prevent undesirable rubbing or chafing.

A plurality of shirt attachment clamps 30 are attached at each proximal end 21 of said first and second elastic bands 24, 25. Each shirt attachment clamp 30 is adapted to securely attach to the bottom of a shirt 40 such that the connection will not unintentionally become undone during the course of the day. When in use, the first elastic bands 24 will attach to the front of the shirt 40 through first attachment clamps, and the second elastic bands 25 will attach to the rear of the shirt 40 through second attachment clamps. This will generally form a V-shape when the elastic bands 20 are attached to the knee strap 10. In the preferred embodiment, a compression clamp is used to securely attach each shirt attachment clamp 30 to the shirt 40. In an alternative embodiment, a flange and loop type attachment is used. In a further alternative embodiment, a spring clamp is used.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can and acts of the various embodiments described above can be combined to provide further embodiments.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A shirt stay, comprising:

a knee strap comprising a male pivoting attachment means, said knee strap attaching below the knee of a user, said pivoting attachment means positioned on the outer, lateral side of the knee;

a plurality of elastic bands each comprising a proximal end and a distal end;

a plurality of clamps attached to the proximal ends of each of said plurality of elastic bands, said plurality of clamps securely attaching to the bottom of a shirt;

a female pivoting attachment means positioned at the distal ends of each of said plurality of elastic bands, said female pivoting attachment means removably attaching to said male pivoting attachment means below the knee, said plurality of elastic bands forming a generally V-shape;

wherein the elastic bands will maintain tension between the knee and the shirt, providing an wrinkle-free look that will not become untucked and will not protrude from behind the knee of the pants when seated.

2. A shirt stay according to claim 1, wherein said knee strap further comprises a padded section positioned at the front of the knee and providing support to the knee when kneeling.

3. A shirt stay according to claim 2, wherein said knee strap further comprises a means of attachment opposite said padded section.

4. A shirt stay according to claim 3, wherein said means of attachment is a hook-and-loop type fastener.

5. A shirt stay according to claim 1, wherein said knee strap further comprises an adjustment means.

6. A shirt stay according to claim 1, wherein said elastic bands further comprises a first elastic band and a second elastic band, said first elastic band attaching to the front of a shirt through the plurality of clamps and said second elastic band attaching to the rear of a shirt through the plurality of clamps.

7. A shirt stay according to claim 1, wherein said elastic bands are pivotally attached to said knee strap such that constant tension is maintained even pivoted about said pivotal attachment means when the knees are bent.

8. A shirt stay according to claim 1, wherein said elastic bands further comprise a band length adjustment means.

9. A shirt stay according to claim 1, wherein said knee strap and elastic bands further comprises a hypoallergenic material.

10. A shirt stay according to claim 1, wherein said clamps are compression clamps.

11. A shirt stay according to claim 1, further comprising a pair of knee straps attached below both knees of a user.

* * * * *